US007124750B2

(12) United States Patent
Tsokonas

(10) Patent No.: US 7,124,750 B2
(45) Date of Patent: Oct. 24, 2006

(54) RELATIVE POSITION SENSING FOR AN EXHAUST GAS RECIRCULATION VALVE

(75) Inventor: Stavros Tsokonas, Chatham (CA)

(73) Assignee: Siemens VDO Automotive Inc., Chatham (CA)

( * ) Notice: Subject to any disclaimer, the term of this patent is extended or adjusted under 35 U.S.C. 154(b) by 0 days.

(21) Appl. No.: 10/976,817

(22) Filed: Nov. 1, 2004

(65) Prior Publication Data

US 2005/0092308 A1 May 5, 2005

Related U.S. Application Data

(60) Provisional application No. 60/516,551, filed on Oct. 31, 2003.

(51) Int. Cl.
*F02M 25/07* (2006.01)
*F02M 25/08* (2006.01)

(52) U.S. Cl. ..... 123/568.21; 324/207.21; 324/207.24

(58) Field of Classification Search ..... 123/568.21, 123/568.11, 568.15, 568.16; 324/244, 207.24, 324/207.26, 207.21
See application file for complete search history.

(56) References Cited

U.S. PATENT DOCUMENTS

| | | | | |
|---|---|---|---|---|
| 5,570,015 | A * | 10/1996 | Takaishi et al. | 324/207.21 |
| 5,749,350 | A * | 5/1998 | Bender | 123/568.24 |
| 5,955,881 | A * | 9/1999 | White et al. | 324/207.2 |
| 6,223,733 | B1 * | 5/2001 | Busato et al. | 123/568.18 |
| 6,411,081 | B1 * | 6/2002 | Spellman | 324/207.21 |
| 6,633,157 | B1 * | 10/2003 | Yamaki et al. | 324/207.2 |
| 6,670,806 | B1 * | 12/2003 | Wendt et al. | 324/207.24 |
| 6,930,476 | B1 * | 8/2005 | Kato et al. | 324/207.24 |

* cited by examiner

*Primary Examiner*—Mahmoud Gimie

(57) ABSTRACT

An exhaust gas recirculating valve includes a body, a closure member, a magnet, and a magneto-resistive sensor. The body defines a passage through which exhaust gas flows. The body includes a seat and the passage includes an aperture defined by the seat. The closure member is displaced between first and second configurations with respect to the seat. The first configuration sets at zero percent a percentage of exhaust gas that flows from an exhaust manifold of an internal combustion engine to an intake manifold of the internal combustion engine, and the second configuration sets at 100 percent the percentage of exhaust gas that flows from the exhaust manifold of the internal combustion engine to the intake manifold of the internal combustion engine. The magnet moves congruently with the closure member, and the magneto-resistive sensor detects the movement of the magnet so as to determine the percentage of exhaust gas flow.

12 Claims, 7 Drawing Sheets
(4 of 7 Drawing Sheet(s) Filed in Color)

RELATIVE POSITION SENSING FOR AN EXHAUST GAS RECIRCULATION VALVE

CROSS REFERENCE TO RELATED APPLICATIONS

This application claims the benefit of the earlier filing date of U.S. Provisional Application No. 60/516,551, filed 31 Oct. 2003, which is incorporated by reference herein in its entirety.

FIELD OF THE INVENTION

Emission control systems for vehicles frequently include an Exhaust Gas Recirculation ("EGR") valve to control a flow rate of exhaust gas that is withdrawn from the exhaust system of an internal combustion engine and that is delivered to the intake system of the internal combustion engine.

BACKGROUND OF THE INVENTION

Recirculation of engine exhaust is believed to reduce oxides of nitrogen in combustion products that are emitted to atmosphere from an internal combustion engine. A known EGR system employs an EGR valve that is controlled in accordance with engine operating conditions. Under certain operating conditions, the known EGR valve prevents exhaust gases from flowing into the intake manifold, and during other operating conditions, the EGR valve permits a controlled amount of exhaust gases into the intake manifold. Thus, the known EGR valve regulates the amount of engine exhaust gas that is delivered to an intake system and mixed with a fuel-air mixture that is to be combusted in the engine. It is believed that mixing exhaust gas with the fuel-air mixture limits combustion temperatures and hence reduces the formation of oxides of nitrogen.

The promulgation by various governmental agencies of stringent exhaust emissions regulations has created a need for improved control of EGR valves. Electric actuators are believed to provide one approach to improving EGR valve control; however, such actuators must also be able to operate properly over an extended period of usage in extreme environments that include wide temperature extremes and vibration. For example, it is known to mount an EGR valve to a manifold or a housing that has one port exposed to exhaust gases and another port exposed to an intake manifold of the engine.

Thus, it would be advantageous to provide an EGR system with a valve that improves control of tailpipe emissions, improves vehicle drivability, and/or improves vehicle fuel economy.

SUMMARY OF THE INVENTION

The present invention provides an exhaust gas recirculating valve that includes a body, a closure member, a magnet, and a magneto-resistive sensor. The body defines a passage through which exhaust gas flows. The body includes a seat and the passage includes an aperture defined by the seat. The closure member is displaced between first and second configurations with respect to the seat. The first configuration sets at zero percent a percentage of exhaust gas that flows from an exhaust manifold of an internal combustion engine to an intake manifold of the internal combustion engine, and the second configuration sets at 100 percent the percentage of exhaust gas that flows from the exhaust manifold of the internal combustion engine to the intake manifold of the internal combustion engine. The magnet moves congruently with the closure member, and the magneto-resistive sensor detects the movement of the magnet so as to determine the percentage of exhaust gas flow.

The present invention also provides valve that includes a seat, a closure member, a magnet and a sensor. The seat defines an aperture. The closure member is displaced between a first configuration that occludes the aperture and a second configuration that is spaced from the seat. The magnet moves congruently with the closure member. And the sensor detects movement of the magnet so as to quantify positioning of the closure member with respect to the seat.

The present invention also provides a system to recirculate exhaust gas from an exhaust manifold of an internal combustion engine to an intake manifold of the internal combustion engine. The system includes an inlet conduit, an outlet conduit, and a valve that is coupled between the inlet and outlet conduits. The inlet conduit is coupled to the exhaust manifold and receives a first supply of the exhaust gas. The outlet conduit is coupled to the intake manifold and delivers a second supply of the exhaust gas. The second supply is a percentage of the first supply. The valve, which sets the percentage of the first supply that is the second supply, includes a seat, a closure member, a magnet, and a magneto resistive sensor. The seat defines an aperture. The closure member is displaced between first and second configurations with respect to a seat. The valve sets the percentage at zero percent in the first configuration of the closure member, and the valve sets the percentage at 100 percent in the second configuration of the closure member. The magnet moves congruently with the closure member, and the magneto-resistive sensor detects movement of the magnet so as to determine the percentage.

The present invention also provides a relative positioning sensor for a first element that is displaced along an axis with respect to a second element. The relative positioning sensor includes a magnet that moves congruently with the first element, and includes a magneto-resistive detector of the magnet's movement so as to quantify relative positioning of the first and second elements.

The present invention also provides a method of quantifying relative positioning between a movable element that is displaced along an axis with respect to a fixed element. The method includes coupling a magnet, which develops a magnetic field, to a first one of the movable and fixed elements, disposing a magnetic field sensor on a second one of the movable and fixed elements, and detecting with the magnetic field sensor changes in orientation of the magnetic field as the movable element is displaced with respect to the fixed element.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
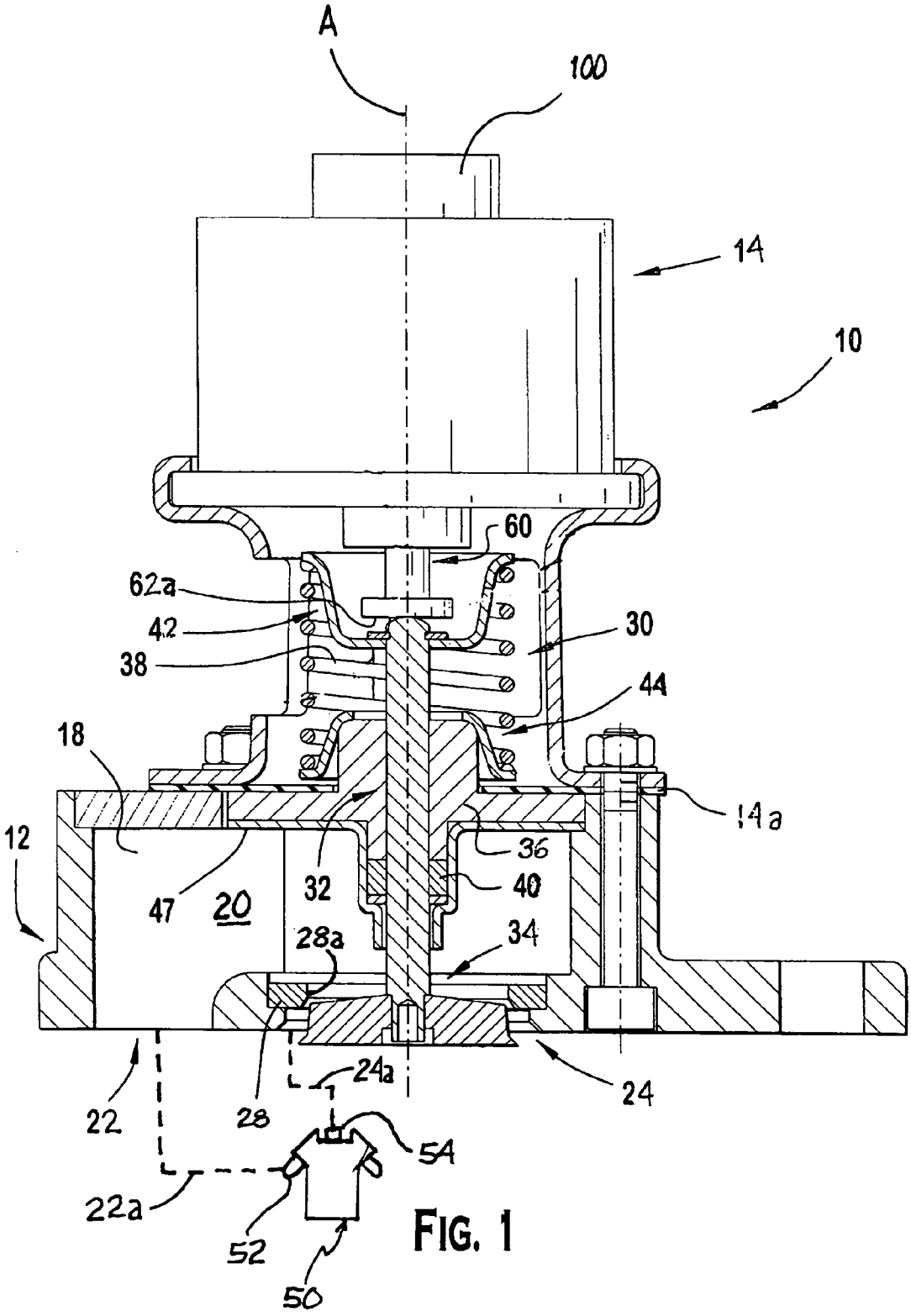
FIG. 1 is a cross-section view of an exhaust gas recirculation system including a valve and a relative position sensor according to a first preferred embodiment. The valve is shown in an open configuration.
Figure 2:
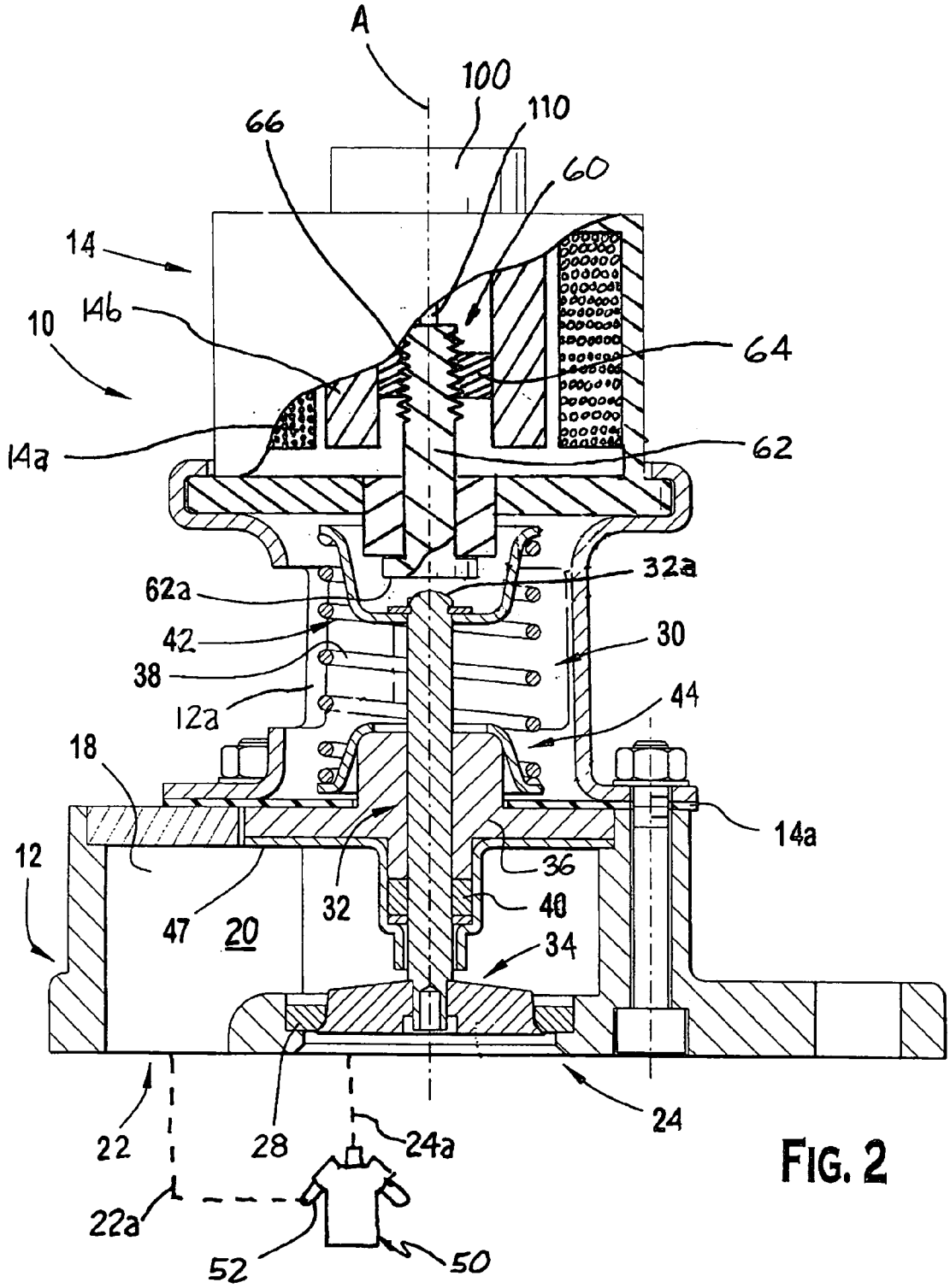
FIG. 2 is a cross-section of the valve in FIG. 1 shown in a closed configuration.

Referring initially to FIGS. 1 and 2, an exhaust gas recirculation (EGR) valve 10 includes a body 12, a valve actuator 14, and a relative positioning detector 100. The body 12, which may be manufactured as a single piece or assembled from plural pieces, generally encloses the valve actuator 14 and the relative position detector 100 into an integrated unit.

The body 12 defines a fluid passage 20 that extends between an inlet 22 and an outlet 24. The inlet 22 may be in fluid communication, via a first conduit 22*a*, with an exhaust manifold 52 of an internal combustion engine 50. And the outlet 24 may be in fluid communication, via a second conduit 24*a*, with an intake manifold 54 of the internal combustion engine 50. Alternatively, flow from the exhaust manifold 52 to the intake manifold 54 may be reversed through the fluid passage 20. The body 12 includes a seat 28, and the fluid passage 20 includes an aperture 28*a* through the seat.

Actuator 14 may include a rotary electric motor (e.g., stepper, synchronous, etc.). Any suitable rotary motor having the desired torque, speed and power characteristics may be used with the valve 10, and its selection depends on the specific application. Preferably, a direct current motor is used, and more preferably, a brushless direct current motor is used. Actuator 14 may be used to configure valve 10 among a plurality of open configurations (which provide various fluid flow rates through the body 12) and a closed configuration. The actuator 14 includes a stator 14*a*, which is fixed with respect to the body 12, and an armature 14*b*, which rotates about an axis A relative to the stator 14*a*.

A converter 60 may convert the rotary motion of armature 14*b* into translational motion. Preferably, the converter 60 includes a threaded rod 62 that cooperatively engages a nut 64. The nut 64 is fixed for rotation with the armature 14*b* and, by virtue of threaded engagement 66, the threaded rod 62 is translated along the axis A in response to rotation of the nut 64. The threaded rod 62 may include, for example, one or more flanges (not shown) that are received in stationary slots or channels (not shown) within the body 12 to prevent the threaded rod 62 from rotating together with the nut 64.

FIG. 1 shows the threaded rod 62 extended so as to open the valve 10, e.g., allowing up to 100 percent of the exhaust gas available at the inlet 22 to flow to the outlet 24. FIG. 2 shows the threaded rod 62 contracted so as to close the valve 10, such that zero percent of the exhaust gas available at the inlet 22 is allowed to flow to the outlet 24.

A closure member 30 includes a stem 32 and a head 34. Preferably, a bearing 36 supports the stem 32 with respect to the body 12. When the actuator 14 displaces the shaft 60 along the axis A, an end 62*a* of the threaded rod 62 applies a force to the stem 32. This applied force causes the stem 32 to be displaced along the axis A and causes the head 34 to be spaced from the seat 28, thereby opening the valve 10 (e.g., as shown in FIG. 1). A resilient element, preferably a compression spring 38, is preferably coupled to stem 32 and biases the closure member 30 into engagement with seat 28.

The closure member 30 and the seat 28 form a pintle-type valve. Other valve types may alternatively be used in place of a pintle-type valve, e.g., a poppet valve.

Preferably, the head 34 is upwardly tapered and the seat 28 is correspondingly shaped to receive the head 34 and to establish a fluid-tight seal in the closed configuration of the valve 10. When valve 10 is in the open configuration, the head 34 is spaced from the seat 28, as can be understood by comparing FIG. 1 with FIG. 2. A stem seal 40, which is preferably made from a high temperature graphite, prevents leakage of exhaust gases along stem 32.

In a preferred embodiment, the spring 38, which is preferably a compression spring, is positioned between two retaining cups 42,44. The retaining cup 42 couples the spring 38 with respect to the stem 32, and the retaining cup 44 is stationary with respect to the body 12. The spring rate of the spring 38 is chosen so that a sufficient pre-load is applied to retain valve 10 in the closed configuration. As the valve I 0 is configured from the closed configuration to an open configuration by virtue of the threaded rod 62 applying a force on the stem 32, spring 38 is compressed between the retaining cups 42,44.

As shown in FIG. 2, the end 62*a* of the shaft 60 may be decoupled from the stem 32. In other words, threaded rod 62 may be spaced from stem 32 so that only spring 38 influences the motion of valve member 30. By virtue of the ability to decouple threaded rod 62 and the stem 32, the valve 10 can be assembled without having to maintain a precise alignment along the axis A and with a minimum tolerance stack-up effect. An end 32*a* of the stem 32 that is decoupled from the end 62*a* of the threaded rod 62 is preferably formed with a curved surface so as to have generally point contact between the threaded rod 62 and the stem 32. Similarly, the end 62*a* of the threaded rod 62 may be provided with a relatively large contact area for stem 32 in the event of slight misalignments during assembly.

It is advantageous to minimize the amount of heat transfer from hot exhaust gases in the fluid passage 20 to the actuator 14, thereby minimizing adverse effects on the performance of valve 10. According to a preferred embodiment, the EGR 10 minimizes heat that is transferred by the body 12 and/or from the stem 32 to the actuator 14. For example, when the stem 32 and the threaded shaft 62 make contact, they do so over a relatively small surface area. Additionally, body 12 may include openings or cutouts 12*a* to allow air to cool the stem 32, and a thermal insulating coramic gasket 14*a* may be incorporated during assembly of the valve 10. Further, the retaining cups 42,44 may also be configured and disposed in the body 12 to dissipate heat.

Figure 3:
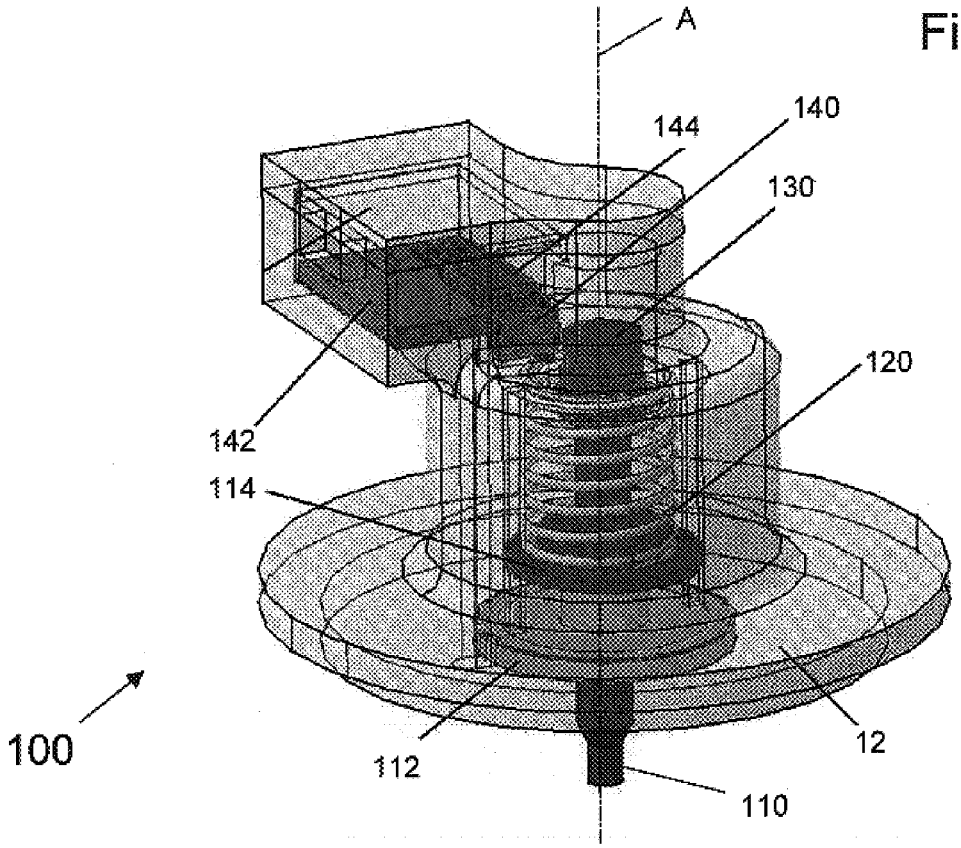
FIG. 3 is an isometric view of the relative position sensor in FIG. 1.

Referring additionally to FIG. 3, the relative position detector 100 is preferably incorporated within the body 12. According to a preferred embodiment, the relative position detector 100 includes a follower 110, a resilient member 120, a magnet 130, and a sensor 140.

The follower 110 preferably extends along the axis A and is supported for relative translation with respect to the body 12 by a bearing 112. Preferably, the follower includes an enlarged portion 114 against which the resilient element 120 is disposed.

The resilient member 120 biases the follower 110 into contiguous engagement with the threaded rod 62. Preferably, the resilient member 120 is a compression spring that extends between the body 12 and the enlarged portion 114 of the follower 110.

The magnet 130 is fixed with respect to the follower 110 so as to congruently move with the displacement of the closure member 30. That is to say, by virtue of the magnet 130 being fixed to the follower 110, the follower 110 being biased by the resilient element 120 into contiguous engagement with the threaded rod 62, and the threaded rod 62 displacing the closure member 30, movement of the closure member 30 is faithfully tracked by movement of the magnet 130. Alternatively, the magnet 130 may be directed fixed either to the threaded rod 62 or to the closure member 30, which would eliminate the need for the follower 110 and the resilient element 120. The magnet 130 is preferably a rare-earth permanent magnet of a neodymium, iron and boron composition. Of course, other magnets may be used, including ceramic magnets, Alnico magnets, and electromagnets, and other compositions of rare-earth permanent magnets may be used, e.g., samarium-cobalt.

Preferably, the sensor 140 is mounted on a printed circuit board 142 that is supported on the body 12. The sensor 140 may include a Wheatstone bridge 144. Other features that may be incorporated on the circuit board 142 include a processor that enables programming of different output signals in accordance with the particular implementation of the relative position detector 100.

Figure 4:
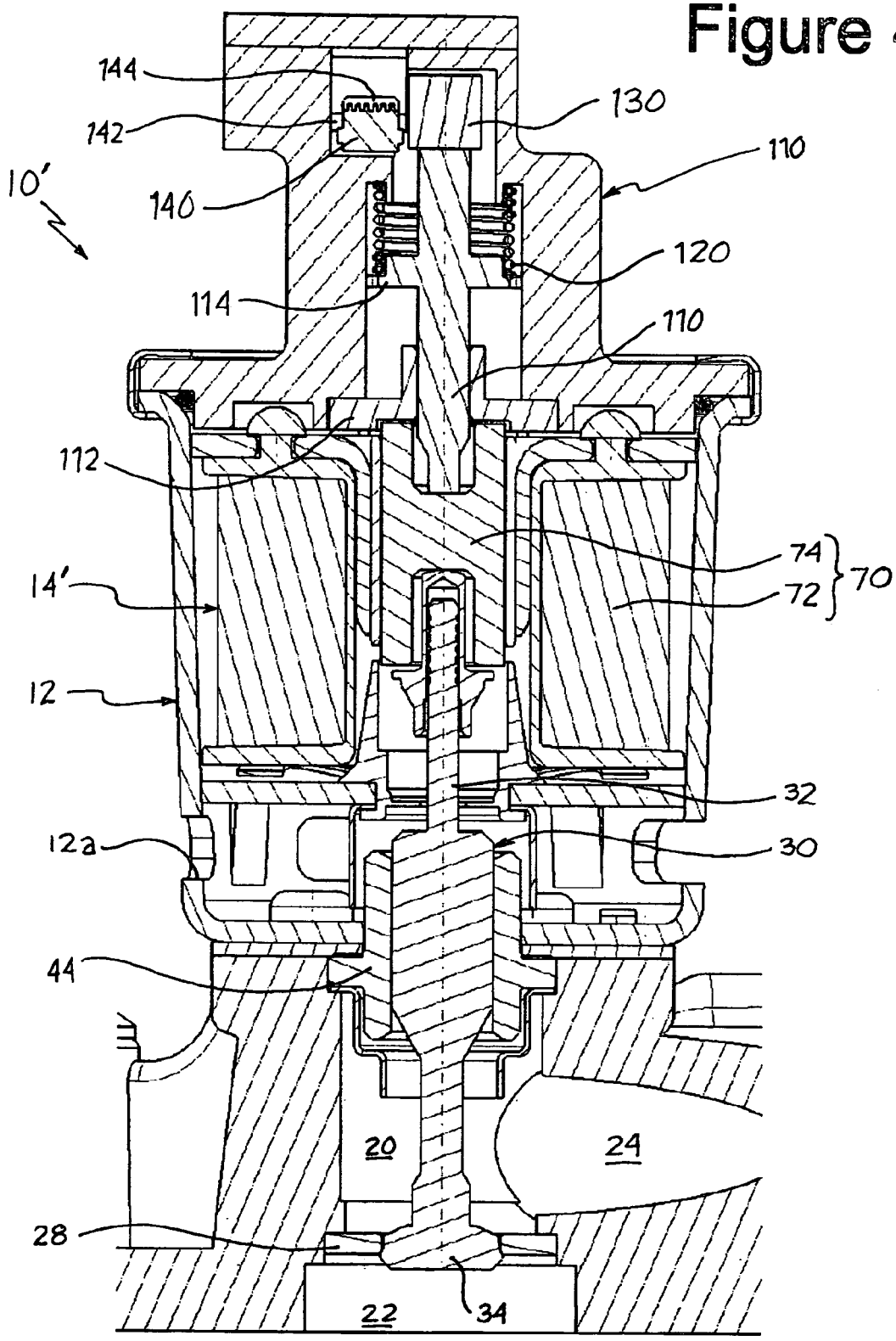
FIG. 4 is a cross-section view of an exhaust gas recirculation system including a valve and a relative position sensor according to a second preferred embodiment.

Referring now to FIG. 4, there is shown an alternate preferred embodiment of an exhaust gas recirculation (EGR) valve 10'. In the EGR valve 10', the valve actuator 14' includes an electric solenoid 70. Thus, in lieu of an electric motor and a rotary-to-linear motion converter, as shown in FIGS. 1 and 2, the EGR valve 10' uses the electric solenoid 70, which includes a coil 72 and an armature 74. And the follower 110 is biased by resilient element 120 into engagement with the armature 74. Otherwise, similar reference numbers are used to indicate similar features in the two preferred embodiments. The coil 72 is fixed with respect to the body 12 and the armature 74 is directly fixed with respect to the stem 32 of the closure member 30.

Figure 5:
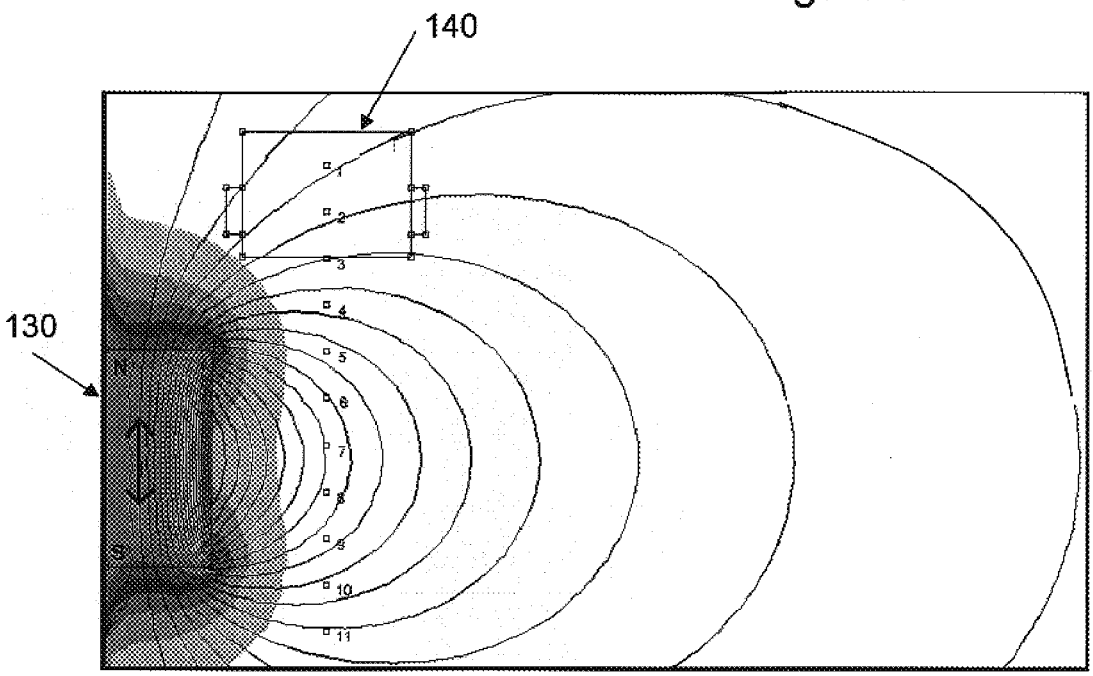
FIG. 5 is a schematic illustration of a relationship between a magnet and a magnetic field sensor according to a preferred embodiment.
Figure 6:
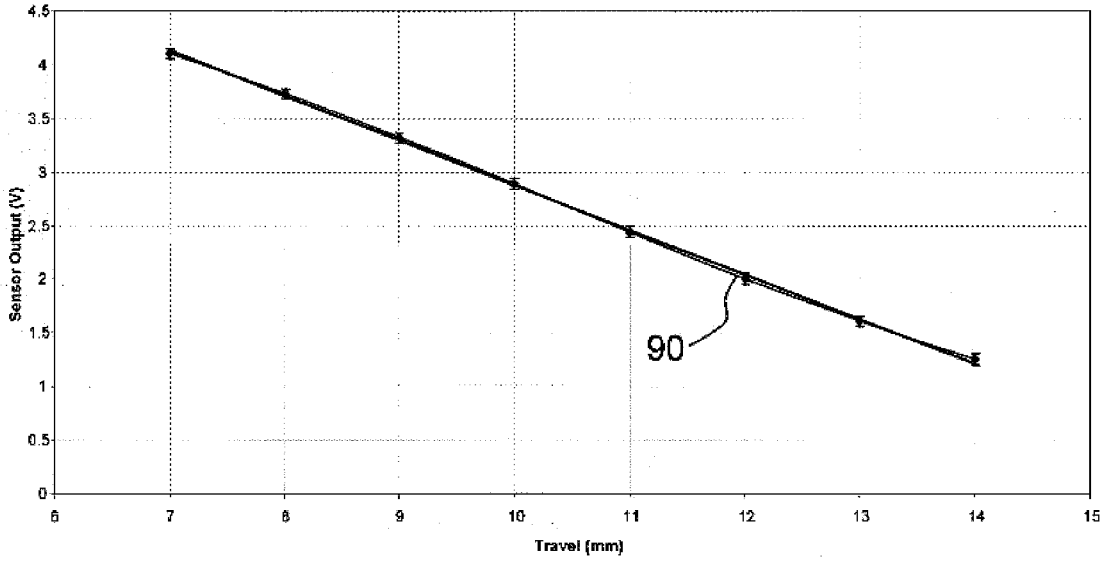
FIG. 6 is a graph depicting the relationship between output signal and relative displacement according to a preferred embodiment.
Figure 7:
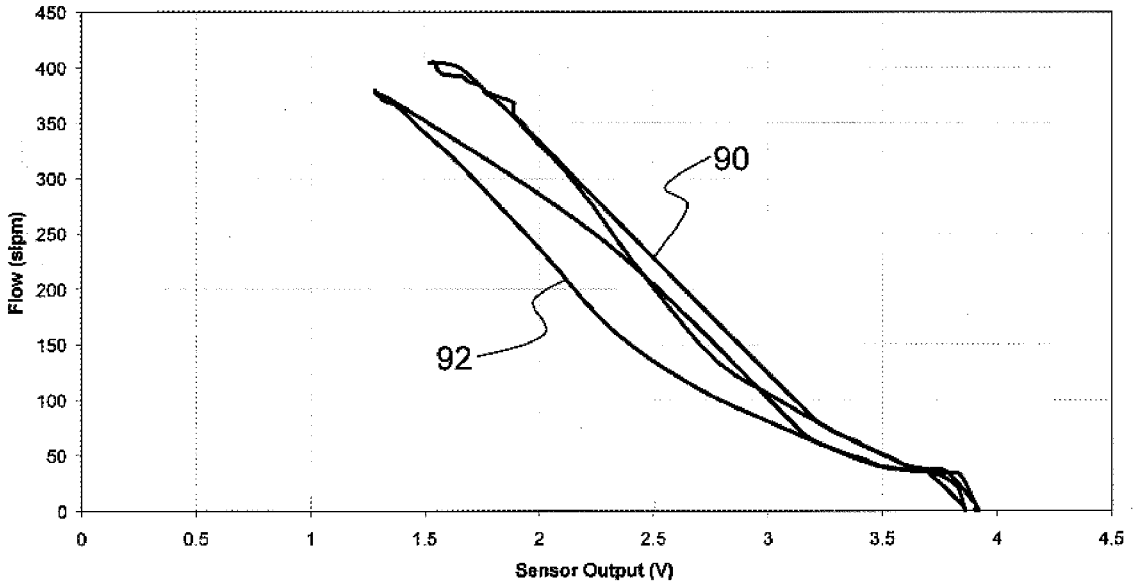
FIG. 7 is a graph depicting the relationship between exhaust gas flow and output signal according to a preferred embodiment.

Referring now to FIGS. 5–7, the interrelationship of the magnet 130 and the sensor 140 will be described. FIG. 5 shows a magnetic field that is developed by the magnet 130, and shows eleven relative positions of the sensor 140 with respect to the magnet 130. The orientation of the magnetic field, e.g., the tangents of the flux lines, changes from approximately +30 degrees from horizontal (at relative position 1) to approximately vertical (at relative position 7) to approximately horizontal (at relative position 11). The sensor 140 detects the changing orientation of the magnetic field, as opposed to variations in the strength of the magnetic field. In fact, the sensor 140 is generally insensitive to the magnitude of the magnetic field, provided that the field strength is at least sufficient to be detected by the sensor 140. It has been found that a field strength of at least 25 kilo-amperes per meter is sufficient at the given lateral spacing between the magnet 130 and the sensor 140. An example of a magneto-resistive sensor is model KMA200 manufactured by Royal Philips Electronics.

Magneto-resistance is a property of ferrous materials. The magneto-resistive sensor 140 takes advantage of this phenomenon by changing its resistance in response to the changing orientation of the magnet field that is developed by the magnet 130 during relative movement. The change in resistance of the magneto-resistive sensor 140 is preferably used with the Wheatstone bridge 144 to quantify the relative position of the magnet 130 with respect to the sensor 140.

Thus, as the sensor 140 moves relative to the magnet 130 along the line from position 1 to position 11, the sensor 140 crosses the field developed by the magnet 130, which changes direction along the line, thereby changing the resistance of the sensor 140.

In contrast to relative positioning sensors that rely on contiguous contact, e.g., potentiometers, the sensor 140 according to a preferred embodiment does not experience wear, which can cause problems like poor repeatability and consistency, as well as very high contact resistance.

Moreover, the sensor 140 according to a preferred embodiment is dependent exclusively on the direction, and not on the magnitude, of the magnetic field and therefore is impervious to changes of magnet strength as the magnet 130 weakens, e.g., at high temperatures. This is in contrast to other non-contact type positioning sensors, e.g., Hall Effect sensors, which are dependent on the strength of the magnetic field.

FIG. 6 shows the nearly perfect linear proportion of an output signal 90 of sensor 140 versus the travel of the closure member 30 in the EGR valve 10,10'. As compared to an output signal 92 of a contact-type sensor, the output signal 90 exhibits less hysteresis, which is a great advantage. Additionally, the sensor 140 may be coupled with a processor, as discussed above, such that the slope and span of the curve can be programmed to match the output of a contact sensor, as shown in FIG. 7 by the flow curves through the EGR valve 10,10'.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. An exhaust gas recirculating valve comprising:

a body defining a passage through which exhaust gas flows, the body includes a seat, and the passage includes an aperture defined by the seat;

a closure member being displaced between first and second configurations with respect to the seat, the first configuration setting at zero percent a percentage of exhaust gas flowing from an exhaust manifold of an internal combustion engine to an intake manifold of the internal combustion engine, and the second configuration setting at 100 percent the percentage of exhaust gas flowing from the exhaust manifold of the internal combustion engine to the intake manifold of the internal combustion engine;

a magnet moving congruently with the closure member; and a magneto-resistive sensor detecting movement of the magnet so as to determine the percentage.

2. The valve according to claim 1, wherein the valve comprises:

an electromagnetic actuator displacing the closure member along an axis between the first and second configurations of the closure member; and a first resilient element extending between the body and the closure member, the first resilient element biasing the closure member toward the first configuration of the closure member.

3. The valve according to claim 2, wherein the electromagnetic actuator comprises at least one of an electric solenoid and an electric motor.

4. The valve according to claim 1, wherein the closure member comprises a head and a stem extending from the head, the head contiguously engages the seat so as to occlude the aperture in the first configuration, and the head is spaced from the seat in the second configuration.

5. A system to recirculate exhaust gas from an exhaust manifold of an internal combustion engine to an intake manifold of the internal combustion engine, the system comprising:

an inlet conduit being coupled to the exhaust manifold and receiving a first supply of the exhaust gas;

an outlet conduit being coupled to the intake manifold and delivering a second supply of the exhaust gas, the second supply being a percentage of the first supply; and a valve coupled between the inlet and outlet conduits, the valve setting the percentage of the first supply that is the second supply, the valve including:

a seat defining an aperture;

a closure member being displaced between first and second configurations with respect to a seat, the first configuration setting the percentage at zero percent, and the second configuration setting the percentage at 100 percent;

a magnet moving congruently with the closure member; and a magneto-resistive sensor detecting movement of the magnet so as to determine the percentage.

6. The system according to claim 5, wherein the valve comprises:

a body defining a fluid passage providing exhaust gas communication between the inlet and outlet conduits, the body includes a seat and the fluid passage includes and aperture in the seat, the aperture is occluded by the closure member in the first configuration, the closure member is spaced from the seat in the second configuration, and the magneto-resistive sensor is fixed with respect to the body;

a first resilient element extending between the body and the closure member, the first resilient element biasing the closure member along an axis toward the first configuration of the closure member; and an electromagnetic actuator displacing the closure member between the first and second configurations of the closure member.

7. The system according to claim 6, wherein the closure member comprises a head and a stem, the head contiguously engages the seat in the first configuration, and the stem projects from the head and extends along the axis.

8. The system according to claim 7, wherein the electromagnetic actuator comprises:

an electric solenoid displacing the closure member between the first and second configurations of the closure member, the electric solenoid includes a stator being fixed to with respect to the body and an armature fixed with respect to the stem of the closure member; and a first bearing supporting translation along the axis of the armature with respect to the body.

9. The system according to claim 8, wherein the valve comprises:

a follower translating along the axis, the magnet being fixed to the follower;

a second bearing supporting translation along the axis of the follower with respect to the body; and a second resilient element extending between the body and the follower, the second resilient element biasing the follower into contiguous engagement with the armature.

10. The system according to claim 6, wherein the electromagnetic actuator comprises:

an electric motor displacing the closure member between the first and second configurations of the closure member, the electric motor including a stator being fixed with respect to the body, and the armature rotating about the axis;

a converter of rotary motion to linear motion including a threaded rod and a nut cooperatively engaging the threaded rod, the nut rotating with the armature, and the threaded rod translating along the axis so as to displace the closure member from the first configuration toward the second configuration; and a first bearing supporting translation along the axis of the threaded rod with respect to the body.

11. The system according to claim 10, wherein the valve comprises:

a follower translating along the axis, the magnet being fixed to the follower;

a second bearing supporting translation along the axis of the follower with respect to the body; and a second resilient element extending between the body and the follower, the second resilient element biasing the follower into contiguous engagement with the threaded rod.

12. The system according to claim 5, wherein the magneto-resistive sensor is electrically coupled to a Wheatstone bridge.

* * * * *